United States Patent [19]

Pane, Jr. et al.

[11] Patent Number: 4,609,150

[45] Date of Patent: Sep. 2, 1986

[54] FUEL NOZZLE FOR GAS TURBINE ENGINE

[75] Inventors: Francis C. Pane, Jr., South Windsor; John A. Matthews, Melrose; Richard R. Wright, Willimantic; John M. Sarnik, Marlborough; Thomas Frasca, Wethersfield, all of Conn.

[73] Assignee: United Technologies Corporation, Hartford, Conn.

[21] Appl. No.: 515,097

[22] Filed: Jul. 19, 1983

[51] Int. Cl.[4] ..... B05B 15/00

[52] U.S. Cl. ..... 239/397.5; 239/400; 239/404; 239/406; 239/419.5; 239/591

[58] Field of Search ..... 239/404, 405, 406, 400, 239/419, 419.5, 397.5, 424, 431, 591

[56] References Cited

U.S. PATENT DOCUMENTS

| | | | |
|---|---|---|---|
| 2,577,550 | 12/1951 | Wahlin | 239/424 |
| 3,684,186 | 8/1972 | Helmrich | 239/400 |
| 3,904,119 | 9/1975 | Watkins | 239/431 |
| 3,980,233 | 9/1976 | Simmons et al. | 239/404 |
| 4,290,558 | 9/1981 | Coburn et al. | 239/406 |

*Primary Examiner*—Andres Kashnikow
*Assistant Examiner*—Michael J. Forman
*Attorney, Agent, or Firm*—Norman Friedland

[57] ABSTRACT

A fuel nozzle for a gas turbine engine is constructed with two major castings where one is the support and the other is the head, both welded together adjacent the fuel orifice plate. The fuel passage is cast into the support providing a smooth radius from the radial to axial flow path and a smooth transition from the circular to the annular cross section. This configuration allows dimension control over the filming lip and other critical dimensions of the nozzle.

5 Claims, 3 Drawing Figures

FIG. 2
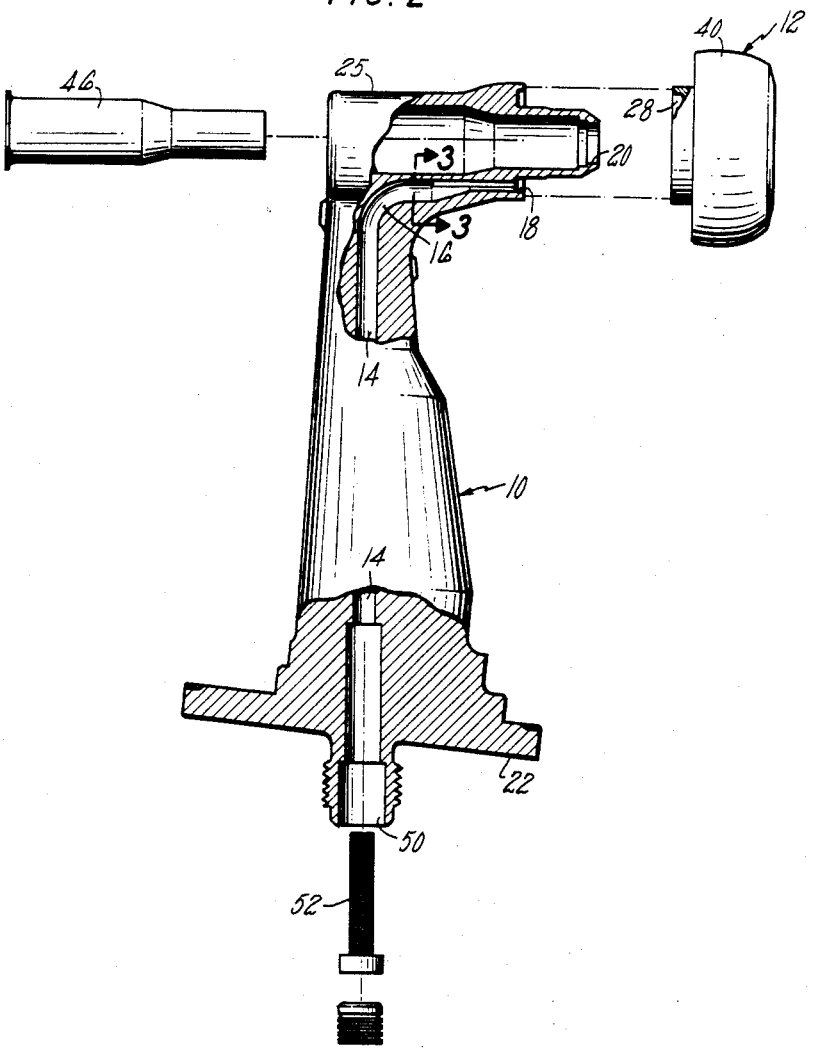
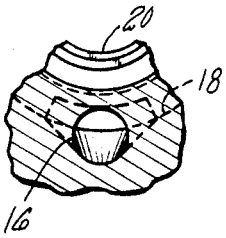
FIG. 3

FUEL NOZZLE FOR GAS TURBINE ENGINE

DESCRIPTION

1. Technical Field

This invention relates to gas turbine engines and particularly to the fuel nozzle for the main burner and the construction thereof.

2. Background Art

A problem inherent in the heretofore conventional fuel nozzles for a gas turbine engine is that because of the hostile environment to which it was subjected, it would assume different dimensions at different points of the engine operating envelope. Thus, if the filming lip was at the optimum dimension for low power, it wasn't necessarily at the optimum dimension at high power. It was a compromise to design the nozzle with the proper dimensions so as to obtain the fuel spray quality and swirl strength for a given operating condition while one would want to match these criteria to the combustor for optimum performance for the entire operating envelope.

Another problem presented by the heretofore conventional fuel nozzle is that it was difficult, if not impossible to achieve a smooth aerodynamically-shaped fuel passage from the entrance of the nozzle support structure to the exit at the nozzle's discharge orifice. In certain embodiments angular disposed passages were drilled through the support incurring sharp bends and thus, impairing the flow, resulting in pressure losses. In embodiments where the body was made in several pieces, parting planes were necessary resulting in differential expansions and contractions which impaired dimensional control.

We have found that we can provide an efficacious fuel nozzle by casting the fuel support and nozzle into two portions, one being the angular support structure housing the major fuel passageway and the other being the nozzle head that provides the film lips, secondary air swirler vanes, frustoconical air passage and fuel swirler orifice plate. Because of this configuration, the fuel passageway can be cast so that it provides an aerodynamically-shaped turn and a smooth transition from a circular cross section to an annular cross section. This serves to achieve an unimpaired fuel flow resulting in minimum losses of fuel pressure while providing a high fuel velocity throughout its travel. Such a configuration also assures the minimum amount of coking since the heat transfer to the fuel is limited.

Casting the head portion separate from the support portion, allows the orifice plate for swirling the fuel to be attached to the outer fuel passage in such a manner as to achieve a high degree of dimension control over those elements that govern the fuel distribution. Hence, the head portion is welded to the end of the nozzle support portion and the extant of the forward end to the weldment (joining the two cast pieces) is significantly reduced over heretofore designs. The differential in growth owing to the extreme temperature ranges has minimal effect on the contraction and expansion of the relative distances defining the filming lip, the orifice plate and the weir. This invention also allows the orifice plate and the adjacent lip to be disposed relatively close to the filming lip as compared to the heretofore known nozzle configurations. Because of the weldment being relatively close to the filming lip, the present invention minimizes relative axial growth between the air lip and fuel filming lip enhancing stability throughout the operating regime of the fuel nozzle, also assuring uniformity from nozzle to nozzle.

DISCLOSURE OF INVENTION

An object of this invention is to provide an improved nozzle for a gas turbine engine. The nozzle structure is cast into two separate parts, the main support structure having a cast radiused turn passageway and the head portion having the air swirler vanes, frusto conical air passage and fuel swirl orifice plate. A feature of this invention is to join the cast portions close to the fuel discharge end of the nozzle at the juncture where the fuel passage in the main support fairs from a circular cross section to the annular cross sections.

Other features and advantages will be apparent from the specification and claims and from the accompanying drawings which illustrate an embodiment of the invention.

BRIEF DESCRIPTION OF DRAWINGS

FIG. 2 is an expanded view, partly in section and partly in elevation showing the separate parts of the fuel nozzle and support; and FIG. 3 is a sectional view taken along the lines 3—3 of FIG. 2 showing the circular to annular transitional portion of the fuel passageway.

BEST MODE FOR CARRYING OUT THE INVENTION

Figure 1:
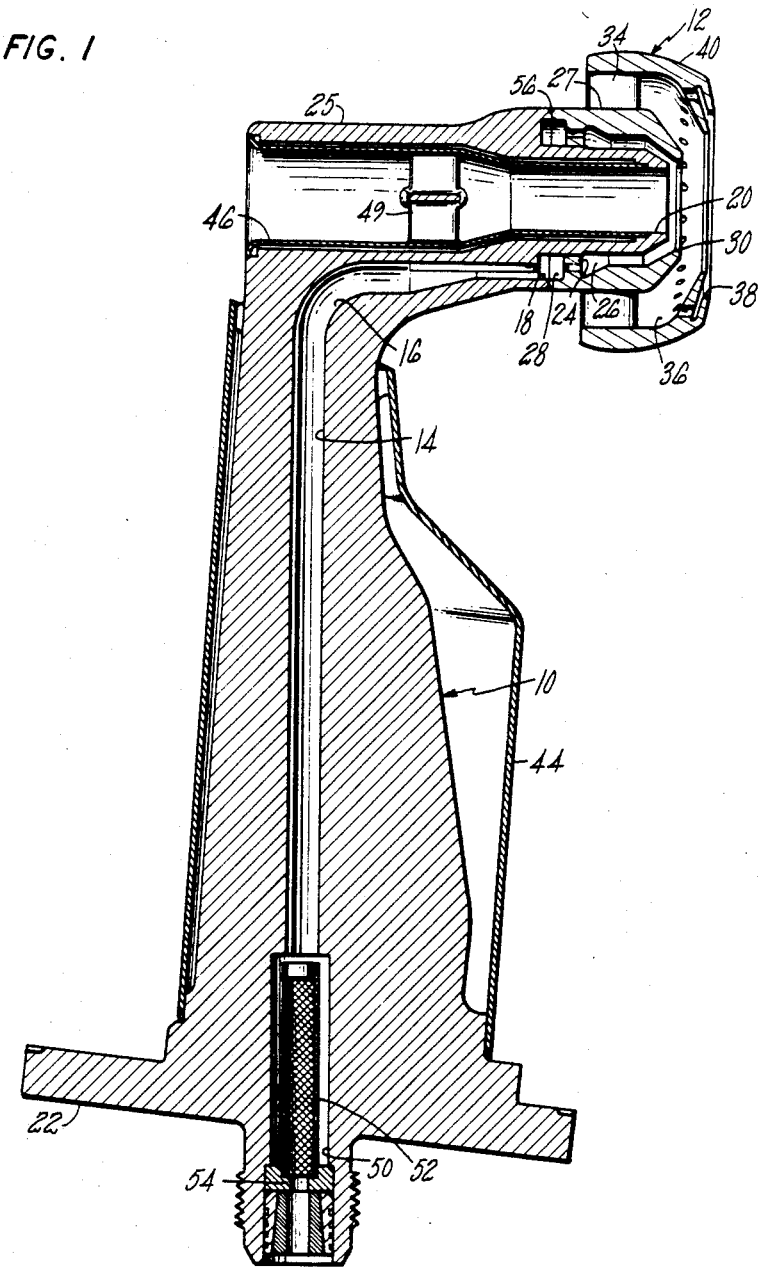
FIG. 1 is a sectional view of the fuel nozzle and support.

Referring now to the preferred embodiment depicted in FIGS. 1–3, the fuel nozzle and support is basically cast in two separate portions, the support 10 and head 12. As is typical in aircraft engines, the fuel support houses the fuel passages which serve to flow fuel to the nozzle to discharge axially into the burner after being admitted thereto in a radial direction. Obviously the fuel must turn 90° to achieve this directional change. According to this invention the fuel passage 14 achieves the 90° directional change by casting a smooth radius 16 directly in the support structure 10. Up to this point the fuel passage 14 is circular in cross section and from this bend to the end of this casting the fuel passage flares from a circular cross section to an annular one at the juncture point 18. This transition, as best seen in FIG. 3, makes a gradual and smooth change from the circular segment to the annular segment, thus assuring a minimal loss in fuel pressure. Likewise, the radius bend 16 also provides a smooth flow from the radial to axial direction. The consequence of these features is to minimize pressure losses in the fuel system and to manifest a uniform distribution of fuel exiting the fuel nozzle.

An axial open ended passageway 20 is cast in the upper end of the support structure 10 in the axially extending portion 25 remote from the base 22. This serves to admit air into the combustion zone (not shown) centrally of the swirling fuel discharging from the fuel swirler orifice plate 24 formed between the annular cast passages 26 and 28 formed in the head portion 12.

As is conventional in fuel nozzles the wall 27 of the head 12 surrounding the annular fuel passage 26 extends radially inward at the discharge end toward the fuel nozzle center line and defines a fuel film lip 30 which serves to help form an annular film of fuel discharge into the combustion zone. The secondary air swirler vanes 34 are cast into head 12 in the frustoconically-shaped air passage 36. An additional lip 38 extending radially from the outer wall 40 toward the nozzle center line and serves to improve durability, prevent carbon accumulation and enhance the spray pattern.

The nozzle is provided with an outer heat shield 44 (FIG. 1) that surrounds the lower portion of the nozzle support 10 and serves as a thermal barrier precluding coking. Inasmuch as the fuel nozzle support extends in the stream of the working medium, the heat shield 44 is aerodynamically-shaped to minimize pressure losses and wakes thereby improving the flow into the combustor so as to improve combustor durability and performance.

Another heat shield member 46 is fitted into the air passage 20 and serves to minimize coking of the fuel in the fuel passage and provides an aerodynamic surface for the smooth flow of air being emitted into the combustion chamber. Air swirlers 49 are formed integrally with the heat shield 46 and provides proper swirl characteristics imparted to the air so as to optimize spray angle size and distribution of fuel droplets.

The fuel inlet 50 is integrally cast into the bottom of the nozzle support 10 and provides a high strength cool environment for housing the strainer 52 and trim orifice 54 frictionally fitted into bore 50 to retain the strainer 52. By virtue of the arrangement the trim orifice can be readily changed and allows for optimum pressure balance.

As will be appreciated from the foregoing, the head is secured to the nozzle support as indicated by the weld 56. This joint may be either welded or brazed. Because of the relatively short distance of the head compared to the axial length of the axially extending wall 25, the axial growth differentials due to temperature differences is minimized and much reduced in comparison to heretofore nozzle designs. This not only enhances nozzle performance, it also provides more stability throughout the operating regimes and provides better nozzle-to-nozzle uniformity.

It should be understood that the invention is not limited to the particular embodiments shown and described herein, but that various changes and modifications may be made without departing from the spirit and scope of this novel concept as defined by the following claims.

We claim:

1. A fuel nozzle for a gas turbine engine including a single casted support member having a radially extending base portion and an axially extending portion, a fuel passageway in said casted support member extending from said base portion to the end of the axial extending portion with a smooth radius turn from said radially extending portion to said axial extending portion and a transition from said turn from a circular to an annular cross section, a single casted head portion including a first frustoconically shaped inner member having an annular fuel swirler orifice formed therein connected in flow relationship with said fuel passageway, a second frustoconically shaped outer member spaced from and surrounding said frustoconically shaped inner member being supported thereto by circumferentially disposed vanes therebetween and defining with the end of said axially extending portion a fuel passage connected in flow relationship to said fuel swirler orifice, the end of said first frustoconically shaped inner member defining a film lip, means for joining said head portion at the end remote from said film lip to said single casted support member at a juncture adjacent said fuel orifice, and an open ended axial flow passageway for conducting air therethrough.

2. A fuel nozzle as in claim 1 including a retractable sleeve in said open ended passageway defining a heat shield for limiting the transfer of heat from said air passageway to said fuel passageway.

3. A fuel nozzle as in claim 2 including swirl vanes disposed in said sleeve to impart a swirling motion to the air passing through said open ended axial flow passageway.

4. A fuel nozzle as in claim 2 including a retractable disc-like element in said fuel passageway adjacent said base portion having a trim orifice and means for securing said disc-like element.

5. A fuel nozzle as in claim 4 including a generally cylindrically shaped heat shield surrounding a substantial portion of said radially extending base portion.

* * * * *